US006240596B1

(12) United States Patent
Kiern

(10) Patent No.: US 6,240,596 B1
(45) Date of Patent: Jun. 5, 2001

(54) DUST SHIELD APPARATUS FOR FLOOR MACHINES

(75) Inventor: Bruce M. Kiern, Metairie, LA (US)

(73) Assignee: Oreck Holdings, LLC, Long Beach, MO (US)

( * ) Notice: Subject to any disclaimer, the term of this patent is extended or adjusted under 35 U.S.C. 154(b) by 0 days.

(21) Appl. No.: 09/393,217

(22) Filed: Sep. 9, 1999

(51) Int. Cl.[7] ..... A47L 5/30

(52) U.S. Cl. ..... 15/385; 15/246.2

(58) Field of Search ..... 15/385, 246.2

(56) References Cited

U.S. PATENT DOCUMENTS

| | | | | |
|---|---|---|---|---|
| 3,531,819 | * | 10/1970 | Lamont | 15/385 |
| 4,178,654 | * | 12/1979 | Mitchell | 15/385 |
| 4,631,775 | * | 12/1986 | Palmer et al. | 15/385 |
| 4,715,807 | * | 12/1987 | Todd et al. | 15/385 |
| 4,731,895 | * | 3/1988 | Zack et al. | 15/385 X |
| 5,711,051 | * | 1/1998 | Roden | 15/385 X |

* cited by examiner

*Primary Examiner*—Chris K. Moore
(74) *Attorney, Agent, or Firm*—Dorsey & Whitney LLP

(57) ABSTRACT

Apparatus and methods for particulate containment and collection are disclosed. In one aspect of the invention, an apparatus includes a shroud attachable to the floor machine and having a skirt portion positionable proximate a work surface to define an at least partially enclosed chamber therebetween, an intake member attached to the shroud and positioned proximate the chamber, the intake member having an intake aperture positionable proximate the work surface and in fluid communication with the chamber; and a vacuum duct having a first end fluidly coupled to the intake member and a second end coupleable to a vacuum source. The containment chamber confines at least some of the particulates produced by the floor machine, thereby improving the effectiveness of the vacuum source. The shroud may be removably attachable to the floor machine. In a further aspect, the shroud may have an exhaust aperture disposed therethrough, the intake member having an engagement portion slideably engaged into the exhaust aperture to permit the intake aperture to be adjustably positionable proximate the work surface. In a further aspect, an apparatus includes a diffusion member disposed proximate the intake aperture and positionable proximate the work surface. The diffusion member creates a high-velocity airflow at or near the work surface, thereby improving the effectiveness of the vacuum source at removing the particulates from the work surface. In still another aspect, an apparatus further includes a floor machine having a treatment member engageable with a work surface. Alternately, an apparatus further includes a vacuum source.

33 Claims, 3 Drawing Sheets

DUST SHIELD APPARATUS FOR FLOOR MACHINES

TECHNICAL FIELD

The present invention relates to apparatus and methods for particulate containment and collection for use with, for example, floor sanders, floor strippers, floor polishers, and the like.

BACKGROUND OF THE INVENTION

Floor machines are a pervasive and well-established appliance for commercial and residential floor care. Floor machines are commonly used, for example, for cleaning, polishing, stripping, and sanding floor surfaces. A variety of floor machine configurations are available to suit the needs of a particular task.

FIG. 1 is a typical floor machine 10 that may be used for treating a floor surface 12. The floor machine 10 includes a motor 14 mounted on a housing 16. A floor treatment device 18 is positioned below the housing 16 and coupled to the motor 14. The floor treatment device 18 is selected depending on the job that is to be performed, and may include, for example, a polishing pad, a stripping pad, a brush, a sand screen, a sanding disk, or other variety of floor treatment device. The floor machine 10 also includes a handle 20 attached to the housing 16. Control grips 22 are located on the handle 20 distant from the housing 16. One commercially-available floor machine of this type is the Low Boy® model floor machine available from the Oreck Corporation of New Orleans, La.

In operation, a user 24 grips the control grips 22 of the handle 20 and starts the motor 14 by squeezing one of the control grips 22. The motor 14 rotates the floor treatment device 18 causing the floor treatment device 18 to perform the desired cleaning, polishing, sanding, or other desired operation on the floor surface 12. The floor treatment device 18 is guided over the floor surface 22 by the user 24 using the handle 20.

In some cases, such as during sanding of wooden floors, the operation of the floor treatment device 18 on the floor surface 12 produces a large amount of particulates 26, such as wood dust. In such a case, a vacuum 30 may be used in conjunction with the floor machine 10 a shown in FIG. 1. The vacuum 10 includes a canister 34 that is coupled to the housing 16 of the floor machine 10 by a vacuum hose 32. In this embodiment, the canister 34 is worn as a "backpack" by the user 24. Alternately, the canister 34 may be mounted on wheels that roll on the floor surface 12, or other suitable vacuum embodiments may be used. One backpack-style vacuum that may be used for this purpose is the Oreck Super Deluxe Compact Canister Vacuum available from the Oreck Corporation of New Orleans, La.

In operation, the floor machine 10 is engaged with the floor surface 12 and operated as described above. The particulates 26 (e.g dirt, debris, wood dust, used floor sealing or floor covering material, etc.) produced by the action of the floor treatment device 18 are lifted from the floor surface 12 into the vacuum hose 32 and are collected in the canister 34. The particulates 26 picked up by the vacuum hose 32 are then stored within the canister 34 for later disposal.

Although desirable results have been achieved using the prior art floor machine 10 and vacuum 30, certain drawbacks exist. For example, because the vacuum hose 32 is mounted in the housing 16, the suction generated by the vacuum 30 is spaced apart from the floor surface 12 by atleast the height of the floor treatment device 18. At this distance, the suction may not be great enough to lift the particulates 26 from the floor surface 12, particularly for those particulates 26 which may collect in cracks or along edges of the floor surface 12.

Also, because the particulates 26 exit randomly from beneath the floor treatment device 18 all around its circumference, the particulates 26 may avoid the suction from the vacuum hose 32 and not be drawn into the canister 34. The particulates 26 that do not exit from beneath the floor treatment device 18 near the vacuum hose 32 may remain on the floor surface 12 or may become airborne. Such airborne particulates 28 may require the use of air filtering devices for capture and removal, adding to the time and expense of the floor treatment operation.

SUMMARY OF THE INVENTION

The present invention is directed toward apparatus and methods for particulate containment and collection for use with, for example, floor sanders, floor strippers, floor polishers, and the like. In one aspect of the invention, an apparatus includes a shroud attachable to a floor machine and having a skirt portion positionable proximate a work surface to define an at least partially enclosed chamber therebetween, an intake member attached to the shroud and positioned proximate the chamber, the intake member having an intake aperture positionable proximate the work surface and in fluid communication with the chamber; and a vacuum duct having a first end fluidly coupled to the intake member and a second end coupleable to a vacuum source. The containment chamber confines at least some of the particulates produced by the floor machine, thereby improving the effectiveness of the vacuum collection process.

In an alternate aspect, the shroud may be removably attachable to the floor machine. In a further aspect, the shroud has an exhaust aperture disposed therethrough, the intake member being at least partially engaged with the exhaust aperture. The intake member may include an engagement portion slideably engaged into the exhaust aperture, permitting the intake aperture to be adjustably positionable proximate the work surface.

In yet a further aspect of the invention, an apparatus includes a diffusion member disposed proximate the intake aperture and positionable proximate the work surface. The diffusion member creates a high-velocity airflow at or near the work surface, thereby improving the effectiveness of the vacuum source at removing the particulates from the work surface. The diffusion member may, for example, include an annular woven pad.

In still another aspect, an apparatus includes a floor machine having a treatment member engageable with a work surface, a shroud attached to the floor machine and having a skirt portion at least partially disposed about the treatment member and positionable proximate the work surface to define an at least partially enclosed chamber therebetween, an intake member attached to the shroud and positioned proximate the chamber, the intake member having an intake aperture positionable proximate the work surface and in fluid communication with the chamber, and a vacuum duct having a first end fluidly coupled to the intake member and a second end coupleable to a vacuum source. Alternately, the apparatus may further include the vacuum source.

DETAILED DESCRIPTION OF THE INVENTION

The following description is generally directed toward apparatus and methods for particulate containment and collection for use with floor machines. Many specific details of certain embodiments of the invention are set forth in the following description and in FIGS. 2–3 to provide a thorough understanding of such embodiments. One skilled in the art, however, will understand that the present invention may have additional embodiments, or that the present invention may be practiced without several of the details described in the following description.

Figure 1:
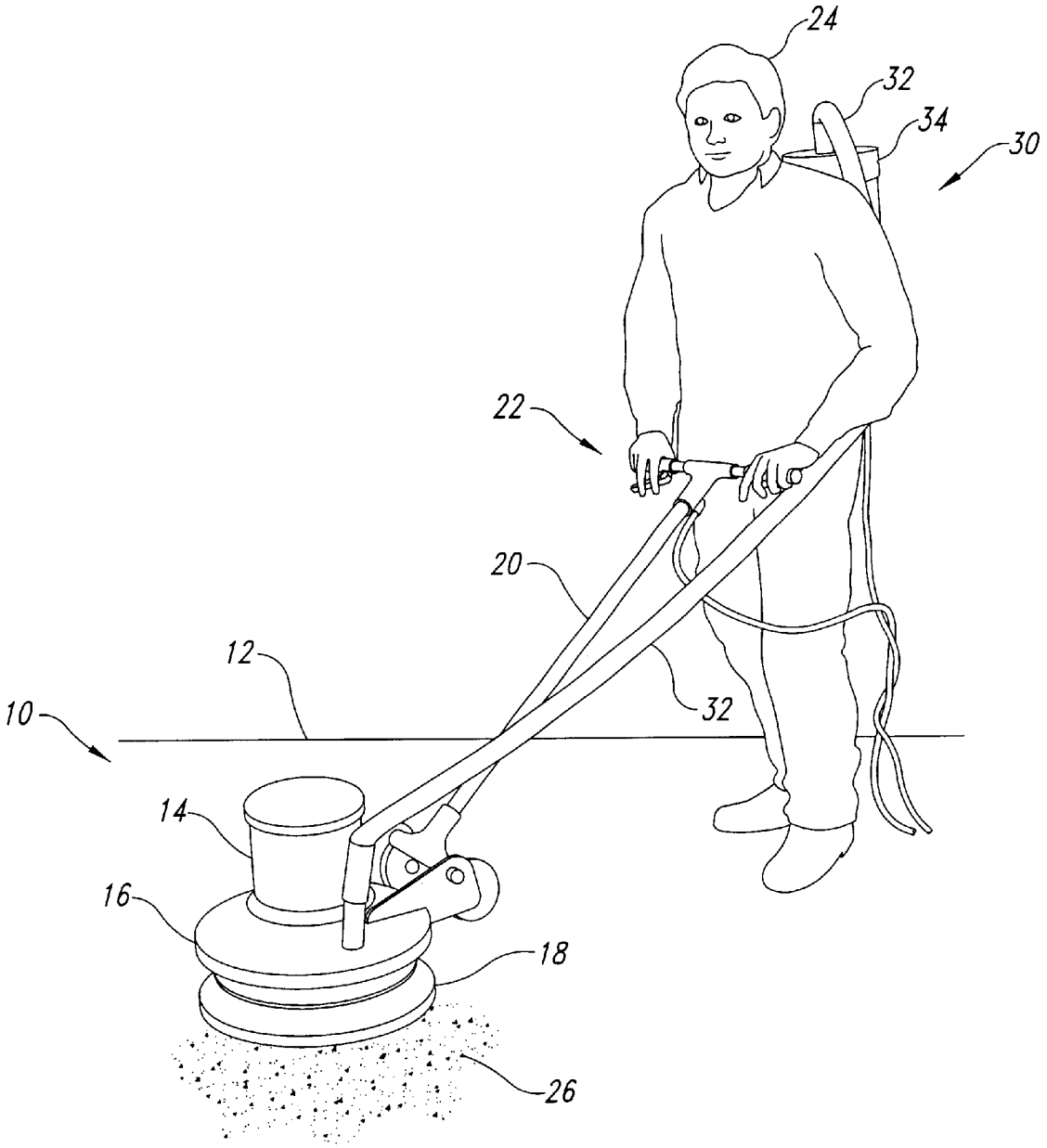
Fig. 1 (Prior Art)
FIG. 1 is an isometric view of a particulate containment and collection apparatus in accordance with the prior art.
Figure 2:
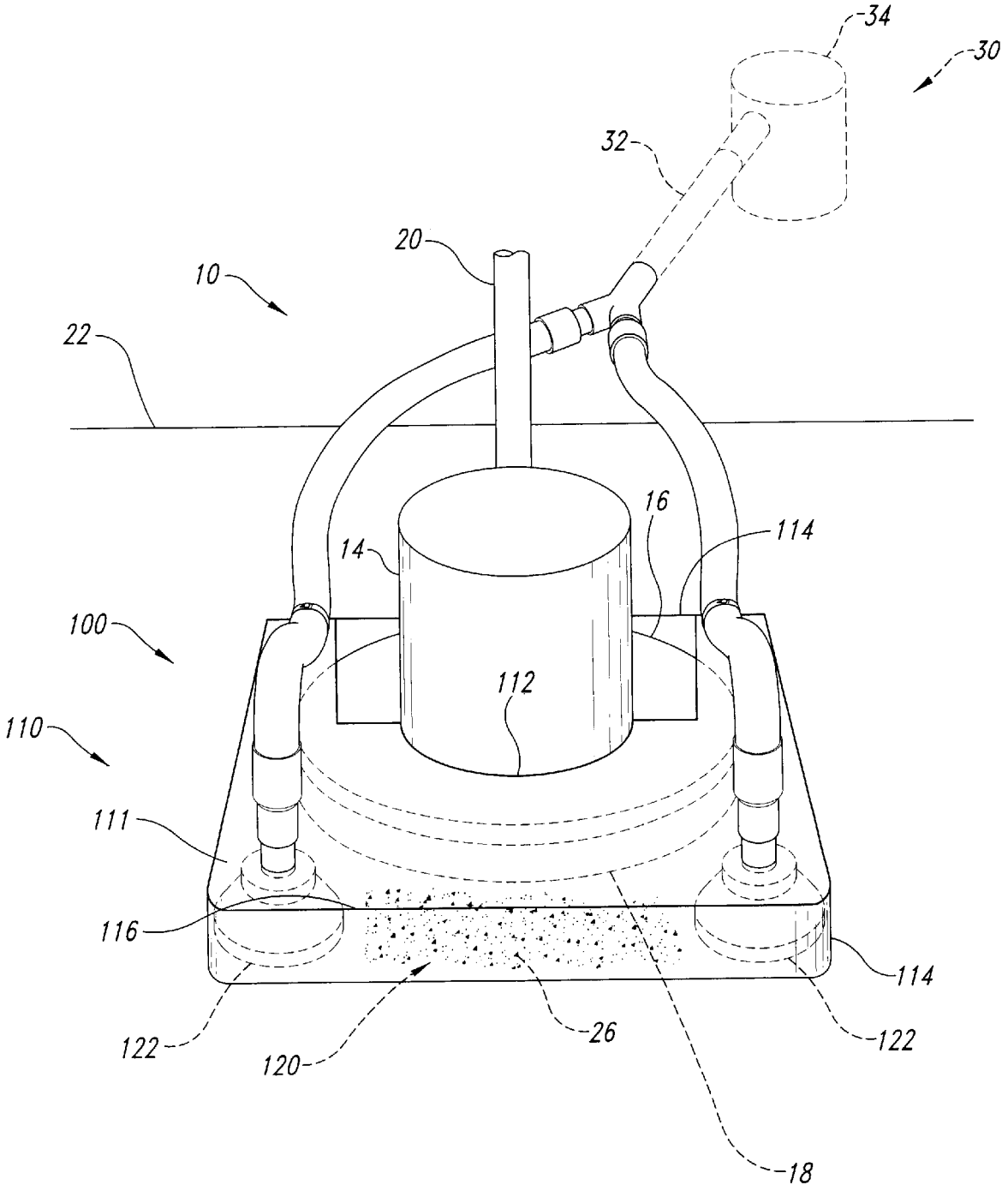
FIG. 2 is a front isometric view of a particulate containment and collection apparatus in accordance with an embodiment of the invention attached to a floor machine.
Figure 3:
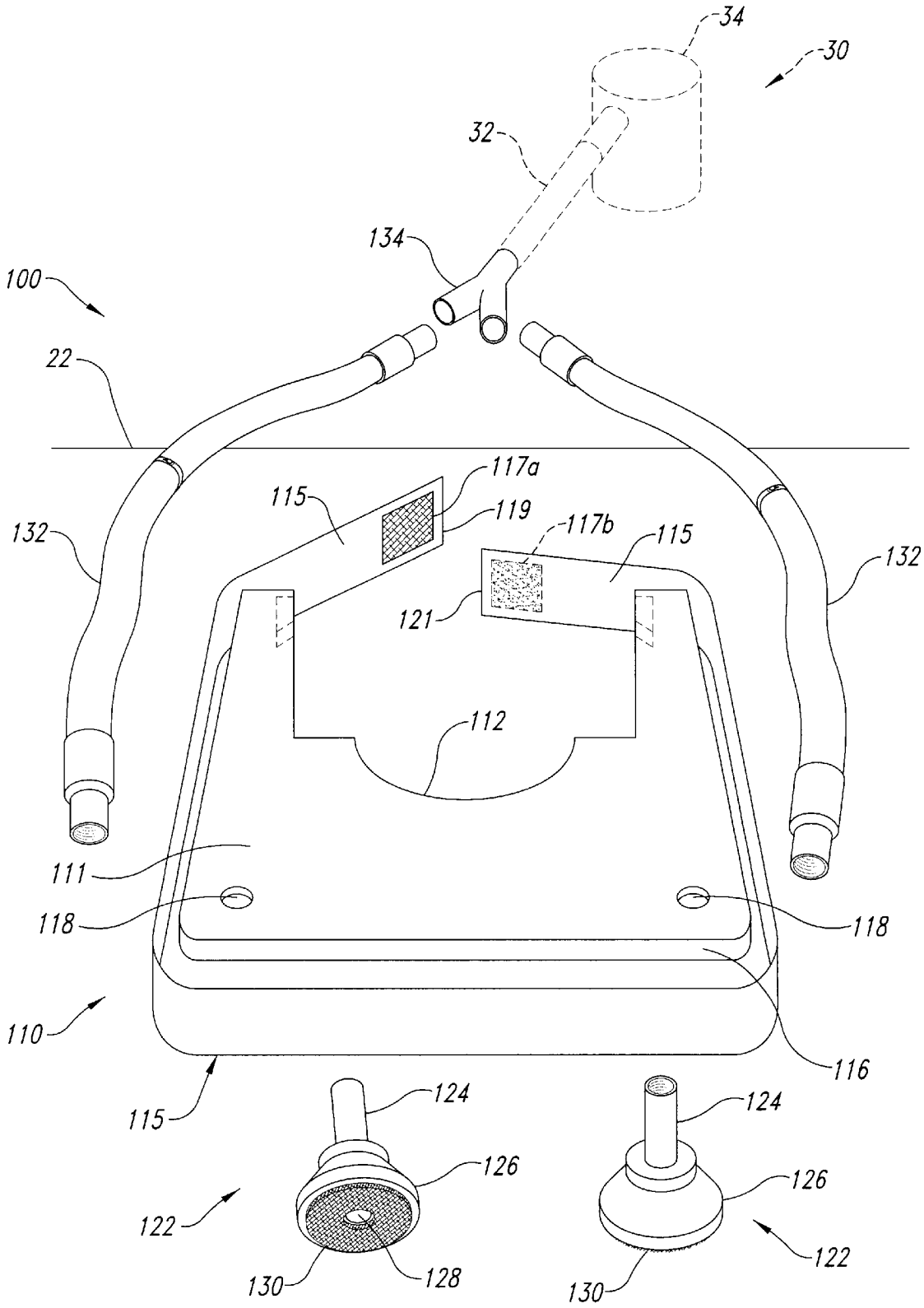
FIG. 3 is a partially-exploded front isometric view of the containment and collection apparatus apparatus of FIG. 2.

FIG. 2 is a front isometric view of a particulate containment and collection apparatus 100 in accordance with an embodiment of the invention. FIG. 3 is a partially-exploded front isometric view of the particulate containment and collection apparatus 100 of FIG. 2. The apparatus 100 is shown in FIG. 2 attached to a floor machine 10.

Referring to FIGS. 2 and 3, the apparatus 100 includes a shroud 110 having a top member 111 with a contoured edge 112 that abuts against and closely fits the motor 14 of the floor machine 10. The top member 111 at least partially rests on the housing 16. The shroud 110 includes a skirt portion 114 including an inner surface 115 that is removably attached to an outer edge 116 of the top member 111. The skirt portion 114 extends downwardly from the top member 111 toward the floor surface 22. The skirt portion 114 extends around the outer edge 116 and along the back of the housing 16.

At the back of the housing 16, securing devices 117*a* and 117*b* (FIG. 3) secure a first end 119 of the skirt portion 114 to a second end 121 of the skirt portion 114. The securing devices 117*a* and 117*b* in this embodiment comprise well-known hook and loop cloth members (e.g. VELCRO®). In turn, the skirt portion 114 secures the shroud 110 to the floor machine 10, and at least partially forms a containment chamber 120 about the floor treatment device 18. The containment chamber 120 is at least partially enclosed by the skirt portion 114, the top member 111, and the floor surface 22.

A pair of exhaust ports 118 are disposed through the top member 111 of the shroud 110. A pair of intake members 122 are attached to the exhaust ports 118 and are disposed within the containment chamber 120. Each intake member 122 includes a cylindrical section 124 coupled to a partially conical section 126. An intake aperture 128 is located within each conical section 126. An annular diffusion member 130 is disposed about each intake aperture 128. In the embodiment shown in FIG. 3, the diffusion members 130 are formed from an open-weave pad material, and the diffusion members 130 extend slightly beyond the intake aperture 128.

Each cylindrical section 124 is slideably coupled with one of the exhaust ports 118 of the top member 111. A vacuum duct 132 is coupled to each cylindrical section 124, the vacuum ducts 132 being joined by a "Y-shaped" or splitter duct 134. The splitter duct 134 may then be coupled with, for example, the single vacuum hose 32 leading to the canister 34 of the vacuum 30, or with some other source of vacuum.

With the particulate containment and collection apparatus 110 attached to the floor machine 10 as shown in FIG. 2, the skirt portion 114 may be adjusted up or down depending on how high the outer edge 116 of the housing 16 is spaced apart from the floor surface 22. Preferably, the skirt portion 116 is adjusted so that it is just touching the floor surface 22. The diffusion members 130 may be in contact with the floor surface 22. In a preferred embodiment, the exhaust ports 118 may be sized slightly larger than the cylindrical sections 124, allowing the intake members 122 to slide up and down relative to the shroud 110 to remain in contact with the floor surface 22 during operation of the floor machine 10.

The floor machine 10 is operated in the manner described above to treat the floor surface 22, thereby producing the particulates 26. At least some of the particulates 26 are substantially trapped and contained within the containment chamber 120 surrounding the floor treatment device 18. Suction produced by the vacuum 30 draws the particulates 26 from the containment chamber 120 through the diffusion members 130 and into the intake apertures 128 of the intake members 122. The diffusion members 130 evenly distribute the vacuum about the periphery of the intake aperture 128 and create a high-velocity airflow condition near the floor surface 22. Because the exhaust ports 118 are slightly larger than the cylindrical section 124, the intake members 122 effectively float to automatically adjust to keep the diffusion members 130 in contact with the floor surface 22 during movement of the floor machine 10.

With the vacuum 30 running, the particulates 26 are drawn into the intake aperture 128 and through the conical and cylindrical sections 126, 124 of the intake members 122, and out of the containment chamber 120 via the exhaust ports 118. The particulates 26 are then drawn through the vacuum ducts 132 and the splitter duct 134 to the canister 34 of the vacuum 30, where the particulates 26 are collected and stored for disposal.

One may note that several of the design features of the particulate containment and collection apparatus 100 may be varied from the particular embodiment described above and shown in the accompanying figures. For example, in the embodiment shown in FIGS. 2 and 3, the skirt portion 114 is flexible and is removably attached to the outer edge 116 by hook and loop cloth members. The skirt portion 114 of the apparatus 100 secures the shroud 110 to the floor machine 10. The skirt portion 114, however, need not be removable from the top member 111 and is not required to be flexible. Furthermore, the shroud 110 may be attached to the floor machine 10 in ways other than by the skirt portion 114, including, for example, by bolting the top member 111 to the housing 16.

Alternately, a greater or fewer number of intake members 122 may be used, or the design of the intake members 122 may be modified from the embodiment shown and described above. For example, the intake members 122 are not required to have a single, circular intake aperture 128, but may have a variety of configurations, such as, for example, an elongated or slot-like shape. Also, the intake members 122 need not communicate with the containment chamber 120 through the top member 111. For example, the exhaust ports 118 may be disposed in the skirt portion 114, or even in the housing 16 of the floor machine 10. Finally, the diffusion members 130 may be eliminated.

The particulate containment and collection apparatus 100 advantageously contains at least some of the particulates 26 within the containment chamber 120. Because the containment chamber 120 is substantially enclosed, fewer of the particulates 26 become airborne, reducing the need for additional air filtering equipment. Also, the containment of at least some of the particulates 26 within the containment chamber 120 may improve the vacuum's effectiveness at picking up the particulates 26 from the floor surface 22.

Another advantage of the apparatus 100 is that the diffusion members 130 create a high-velocity airflow condition at or near the floor surface 22. In this way, the diffusion members 130 further improve the effectiveness of the vacuum 30. Because the particulates 26 are typically located on the floor surface 22, the probability that the particulates 26 will be drawn into the intake apertures 128 by the vacuum 30 is increased by the high-velocity airflow condition. The high-velocity airflow provides additional benefit by improving the removal of particulates 26 that may have fallen into cracks in the floor surface 22. In the embodiment shown in FIG. 3, the weave of the diffusion members 130 is large enough so that the particulates 26 do not become lodged within the diffusion members 130, but rather, pass easily into the intake apertures 128.

Yet another advantage of the containment and collection apparatus 100 is that the device may be easily and efficiently attached to and removed from the floor machine 10. Because the shroud 110 is secured to the housing 16 of the floor machine 10 by the skirt portion 114, the apparatus 100 may be attached to the floor machine 10 without time-consuming bolting or clamping mechanisms, and without permanent modification of the floor machine 10. No special tools or training are required. When the apparatus 100 is not needed, it may be removed, and the floor machine 10 may be operated in the usual manner.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with prior art methods to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein of the invention can be applied to other apparatus and methods for particulate containment and collection for use with floor machines, and not just to the particular apparatus and methods described above and shown in the figures. In general, in the following claims, the terms used should not be construed to limit the invention to the specific embodiments disclosed in the specification. Accordingly, the invention is not limited by the foregoing disclosure, but instead its scope is to be determined by the following claims.

What is claimed is:

1. A particulate collection apparatus for use with a floor machine, comprising:

a shroud attachable to the floor machine and having a skirt portion positionable proximate a work surface to define an at least partially enclosed chamber therebetween;

an intake member attached to the shroud and positioned proximate the chamber, the intake member having an intake aperture positionable proximate the work surface and in fluid communication with the chamber, the intake member further including a diffusion member disposed proximate the intake aperture and positionable proximate the work surface; and a vacuum duct having a first end fluidly coupled to the intake member and a second end coupleable to a vacuum source.

2. The apparatus of claim 1 wherein the shroud includes a contoured edge fittingly engageable with the floor machine.

3. The apparatus of claim 1 wherein the skirt portion includes a flexible portion at least partially engageable about the floor machine.

4. The apparatus of claim 1 wherein the shroud is removably attachable to the floor machine.

5. The apparatus of claim 1 wherein the shroud has an exhaust aperture disposed therethrough, the intake member being at least partially engaged with the exhaust aperture.

6. The apparatus of claim 5 wherein the intake member includes an engagement portion at least partially slideably engaged into the exhaust aperture.

7. The apparatus of claim 1 wherein the intake aperture comprises a circular aperture and the intake member includes an annular diffusion member disposed about the circular aperture, the annular diffusion member being engageable with the work surface.

8. The apparatus of claim 7 wherein the annular diffusion member comprises an annular woven pad.

9. The apparatus of claim 1 wherein the intake member comprises a first intake member and the intake aperture comprises a first intake aperture, further comprising a second intake member attached to the shroud and positioned within the chamber, the second intake member having a second intake aperture positionable proximate the work surface and in fluid communication with the chamber; and a second vacuum duct having an intake end fluidly coupled to the second intake member and an exhaust end coupleable to a vacuum source.

10. The apparatus of claim 1, further comprising a vacuum source coupled to the second end of the vacuum duct.

11. Apparatus for containing and collecting particulates, comprising:

a floor machine having a treatment member engageable with a work surface;

a shroud attached to the floor machine and having a skirt portion at least partially disposed about the treatment member and positionable proximate the work surface to define an at least partially enclosed chamber therebetween;

an intake member attached to the shroud and positioned proximate the chamber, the intake member having an intake aperture positionable proximate the work surface and in fluid communication with the chamber, wherein the intake member includes a diffusion member disposed proximate the intake aperture and positionable proximate the work surface; and a vacuum duct having a first end fluidly coupled to the intake member and a second end coupleable to a vacuum source.

12. The apparatus of claim 11 wherein the skirt portion includes a flexible portion at least partially engageable about the floor machine.

13. The apparatus of claim 11 wherein the shroud has an exhaust aperture disposed therethrough, the intake member being at least partially engaged with the exhaust aperture.

14. The apparatus of claim 11 wherein the intake member comprises a first intake member and the intake aperture comprises a first intake aperture, further comprising a second intake member attached to the shroud and positioned within the chamber, the second intake member having a second intake aperture positionable proximate the work surface and in fluid communication with the chamber; and a second vacuum duct having an intake end fluidly coupled to the second intake member and an exhaust end coupleable to a vacuum source.

15. The apparatus of claim 11, further comprising a vacuum source coupled to the second end of the vacuum duct.

16. A particulate collection apparatus for use with a floor machine, comprising:

a shroud attachable to the floor machine and having a skirt portion positionable proximate a work surface to define an at least partially enclosed chamber therebetween;

an intake member attached to the shroud and positioned proximate the chamber, the intake member having an intake aperture positionable proximate the work surface and in fluid communication with the chamber, wherein the intake aperture comprises a circular aperture and the intake member includes an annular diffusion member disposed about the circular aperture, the annular diffusion member being engageable with the work surface; and a vacuum duct having a first end fluidly coupled to the intake member and a second end coupleable to a vacuum source.

17. The apparatus of claim 16 wherein the shroud includes a contoured edge fittingly engageable with the floor machine.

18. The apparatus of claim 16 wherein the skirt portion includes a flexible portion at least partially engageable about the floor machine.

19. The apparatus of claim 16 wherein the shroud is removably attachable to the floor machine.

20. The apparatus of claim 16, further comprising a vacuum source coupled to the second end of the vacuum duct.

21. A particulate collection apparatus for use with a floor machine, comprising:

a shroud attachable to the floor machine and having a skirt portion positionable proximate a work surface to define an at least partially enclosed chamber therebetween;

a first intake member attached to the shroud and positioned proximate the chamber, the first intake member having a first intake aperture positionable proximate the work surface and in fluid communication with the chamber;

a second intake member attached to the shroud and positioned proximate the chamber, the second intake member having a second intake aperture positionable proximate the work surface and in fluid communication with the chamber; and first and second vacuum ducts fluidly coupled to the first and second intake members, respectively, and coupleable to a vacuum source.

22. The apparatus of claim 21 wherein the shroud includes a contoured edge fittingly engageable with the floor machine.

23. The apparatus of claim 21 wherein the skirt portion includes a flexible portion at least partially engageable about the floor machine.

24. The apparatus of claim 21 wherein the shroud is removably attachable to the floor machine.

25. The apparatus of claim 21 wherein the shroud has an exhaust aperture disposed therethrough, the intake member being at least partially engaged with the exhaust aperture.

26. The apparatus of claim 21 wherein at least one of the first and second intake members includes a diffusion member disposed proximate the at least one of the first or second intake apertures and positionable proximate the work surface.

27. The apparatus of claim 21 wherein at least one of the first and second intake apertures comprises a circular aperture and the at least one of the first and second intake members includes an annular diffusion member disposed about the circular aperture, the annular diffusion member being engageable with the work surface.

28. The apparatus of claim 21, further comprising a vacuum source coupled to at least one of the first and second vacuum ducts.

29. Apparatus for containing and collecting particulates, comprising:

a floor machine having a treatment member engageable with a work surface;

a shroud attached to the floor machine and having a skirt portion at least partially disposed about the treatment member and positionable proximate the work surface to define an at least partially enclosed chamber therebetween;

a first intake member attached to the shroud and positioned proximate the chamber, the first intake member having a first intake aperture positionable proximate the work surface and in fluid communication with the chamber;

a second intake member attached to the shroud and positioned within the chamber, the second intake member having a second intake aperture positionable proximate the work surface and in fluid communication with the chamber; and first and second vacuum ducts fluidly coupled to the first and second intake members, respectively, and coupleable to a vacuum source.

30. The apparatus of claim 29 wherein the skirt portion includes a flexible portion at least partially engageable about the floor machine.

31. The apparatus of claim 29 wherein the shroud has an exhaust aperture disposed therethrough, at least one of the first and second intake members being at least partially engaged with the exhaust aperture.

32. The apparatus of claim 31 wherein the at least one of the first and second intake members includes a diffusion member disposed proximate the at least one of the first and second intake apertures and positionable proximate the work surface.

33. The apparatus of claim 29, further comprising a vacuum source coupled to at least one of the first and second vacuum ducts.

* * * * *